US006380908B1

(12) United States Patent
Andrews et al.

(10) Patent No.: US 6,380,908 B1
(45) Date of Patent: Apr. 30, 2002

(54) PHASED ARRAY ANTENNA DATA RE-ALIGNMENT

(75) Inventors: G. Van Andrews, Plano; Gary A. Frazier, Garland, both of TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/567,543

(22) Filed: May 5, 2000

(51) Int. Cl.[7] ..... H01Q 3/22
(52) U.S. Cl. ..... 343/853; 342/375
(58) Field of Search ..... 343/853, 824; 342/375, 372, 371, 373; 333/164

(56) References Cited

U.S. PATENT DOCUMENTS

| | | | | |
|---|---|---|---|---|
| 3,887,918 A | | 6/1975 | Bailey et al. | 343/17.2 R |
| 4,749,995 A | | 6/1988 | Hopwood et al. | 342/371 |
| 5,223,843 A | | 6/1993 | Hutchinson | 342/352 |
| 5,414,433 A | | 5/1995 | Chang | 342/375 |
| 5,461,389 A | | 10/1995 | Dean | 342/375 |
| 5,764,187 A | * | 6/1998 | Rudish et al. | 342/372 |
| 6,052,085 A | | 4/2000 | Hanson et al. | 342/373 |
| 6,141,371 A | | 10/2000 | Holmes et al. | 375/130 |
| 6,191,735 B1 | * | 2/2001 | Schineller | 342/375 |

FOREIGN PATENT DOCUMENTS

| | | | |
|---|---|---|---|
| GB | 2 130 798 A | 6/1984 | H01Q/3/26 |
| GB | 2 313 711 A | 12/1997 | H01Q/3/26 |

OTHER PUBLICATIONS

Patent applicaton Ser. No. 09/519,069, filed Mar. 3, 2000, entitled *"Digital Phased Array Architecture and Associated Method"*, inventor Gary A. Frazier, Attorney Docket No. RAYT:009, pp. 1–31, 3 pgs. of drawings.

Caputi, William J., Jr., *"Stretch: A Time–Transformation Technique"*, IEEE Transactions on Aerospace and Electronic Systems, vol. AES–7, No. 2, Mar. 1971, pp. 269–278.

Wong, A.C.C., *"Radar Digital Beamforming"*, Military Microwaves '82, Conference Proceedings, London, England, Oct. 20, 1983, pp. 287–294.

Steyskal, Hans, *"Digital Beamforming at Rome Laboratory"*, Microwave Journal, Feb. 1996, 14 pages.

* cited by examiner

*Primary Examiner*—Don Wong
*Assistant Examiner*—James Clinger
(74) *Attorney, Agent, or Firm*—Baker Botts L.L.P.

(57) ABSTRACT

A digital phased array antenna data processing system comprises an antenna array having a plurality of antenna elements connected to an analog-to-digital converter for digitizing received signals. Each analog-to-digital converter is connected to the output of a clock time delay unit also connected to the output of a master clock. The time delay digitized output of the analog-to-digital converter is applied to a data time delay unit for a realignment updated signal from the elements of the antenna.

14 Claims, 4 Drawing Sheets

PHASED ARRAY ANTENNA DATA RE-ALIGNMENT

TECHNICAL FIELD OF THE INVENTION

This invention relates to phased array antenna data processing and, in particular, to a method and apparatus for digital phased array antenna data alignment.

BACKGROUND OF THE INVENTION

Phased array antenna systems generally employ fixed, planar arrays of individual, or subarrays of, transmit and receive elements. Phased array antennas receive signals at the individual elements and coherently reassemble the signals over the entire array by compensating for the relative phases and time delays between the elements. For transmission, the relative phase compensation is applied to the signals at each of the individual elements to electronically steer the beam.

In conventional phased array antennas, the phase shifts and time delays are applied in the analog domain. Typically, the received signals are combined across an array using analog microwave combining circuits and down-converted to an intermediate frequency using analog microwave mixer components. The intermediate frequency is further processed in the analog domain prior to digitization at a low baseband frequency. This analog processing approach is generally not applicable to large arrays, since wide-bandwidth signals do not retain phase coherency over large arrays. Wideband signal processing in large phased arrays requires programmable true-time-delay components to combine the wideband signals over the array. Programmable, analog, true time delays are generally large, complex and costly components.

To help solve this problem for wideband signals, digital processing of the antenna signals has been attempted. This process typically involves digitally processing the received signals at an intermediate frequency. This digital solution requires high precision, high speed, analog-to-digital converters with large power demands to digitize the intermediate frequency.

SUMMARY OF THE INVENTION

In accordance with the present invention, the disadvantages and problems associated with previous phased array antennas have been substantially reduced.

In particular, the present invention provides a method and apparatus for digital phased array antenna data processing. The digital phase array antenna comprises a plurality of antenna elements, each element operable to receive a signal. An analog-to-digital converter is coupled through RF amplification and matching circuitry to at least one of the antenna elements to convert the signal to a multi-bit digital signal. Also included is a data re-alignment circuit coupled to the analog-to-digital converter to correct the received data for angle of arrival.

In another embodiment, there is provided a method for time re-aligning data received at a digital phase array antenna. This method includes the step of receiving a radar signal at an antenna element. Next, the signal is converted to a multi-bit digital signal using an analog-to-digital converter. Finally, the alignment of the multi-bit signal is corrected by applying a master clock to the analog-to-digital converter and applying time delays in the digital domain.

BRIEF DESCRIPTION OF THE DRAWINGS

For a more complete understanding of the present invention, and for further features and advantages, reference is now made to the following description taken in conjunction with the accompanying drawings, in which.

DETAILED DESCRIPTION OF THE INVENTION

Figure 1:
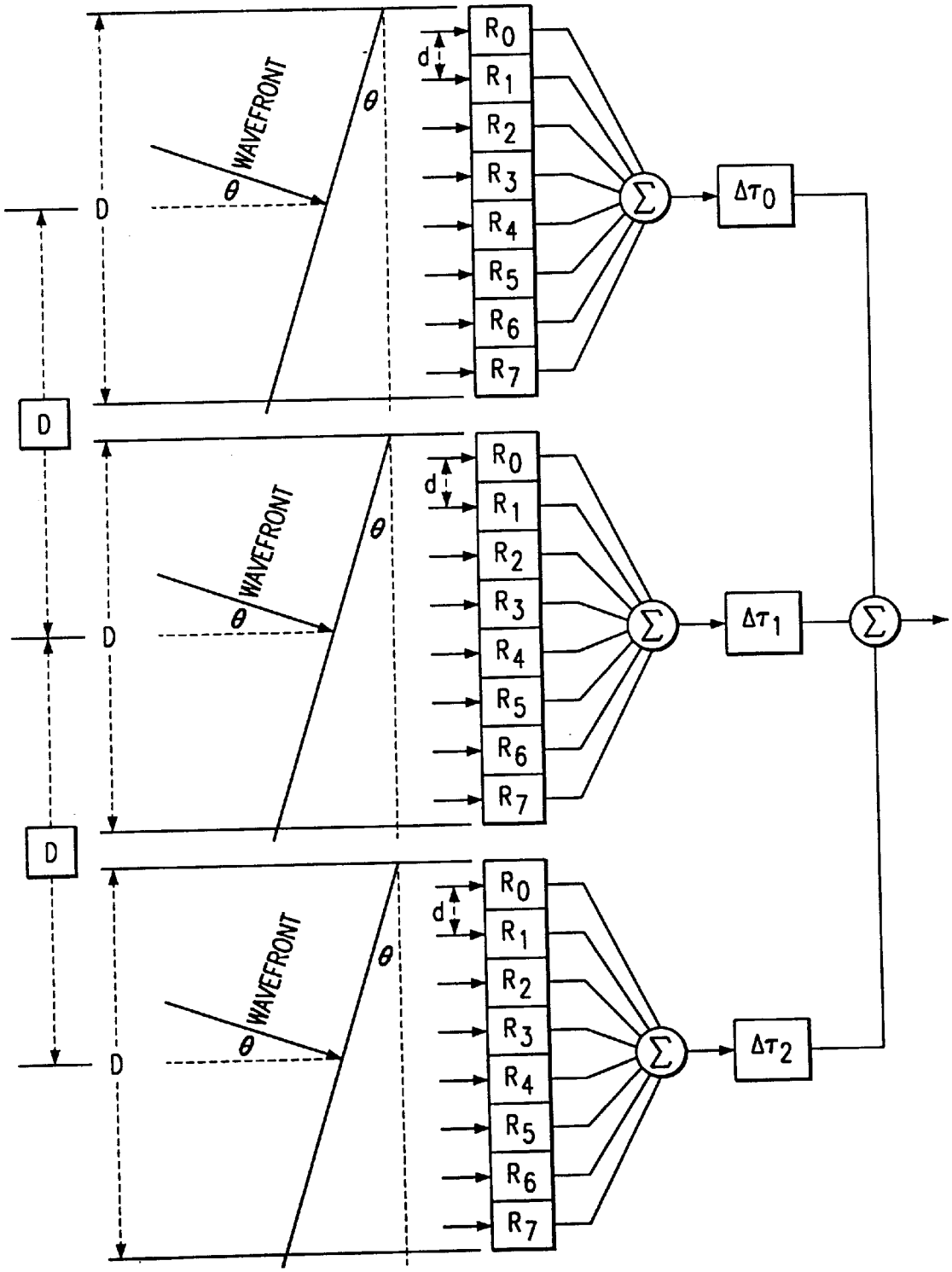
FIG. 1 is a block diagram illustrating subarray partitioning of an antenna with incremental time delay.
Figure 2A:
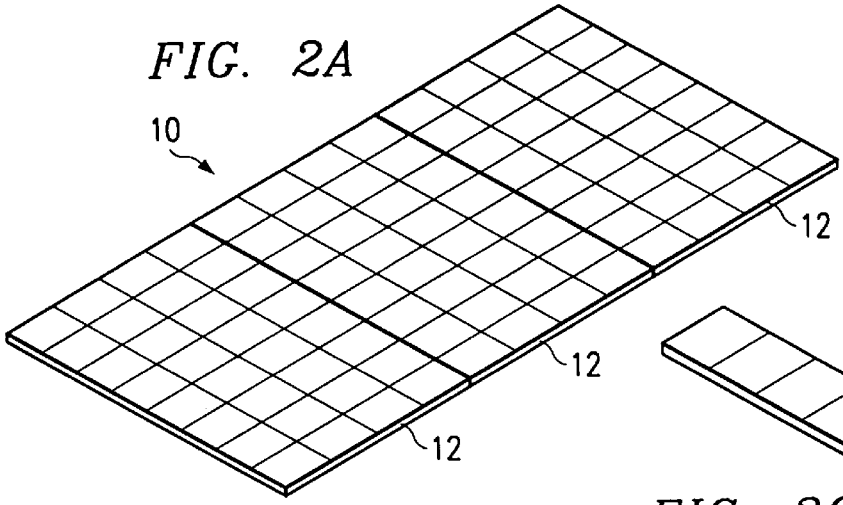
FIGS. 2A, 2B, 2C, 2D and 2E illustrate an exemplary antenna array for use with the data realignment system in accordance with the present invention.
Figure 2C:
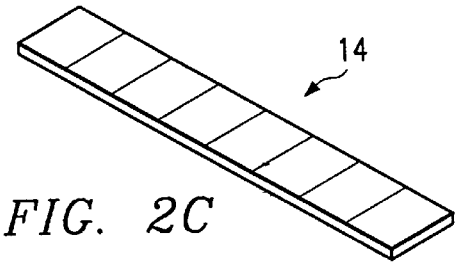
Figure 2B:
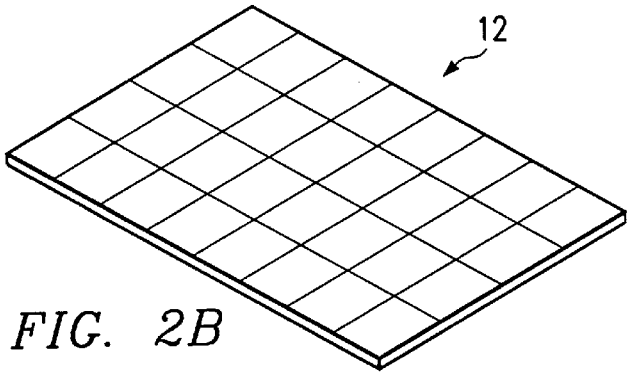
Figure 2D:
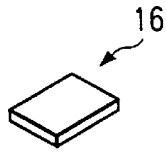
Figure 2E:
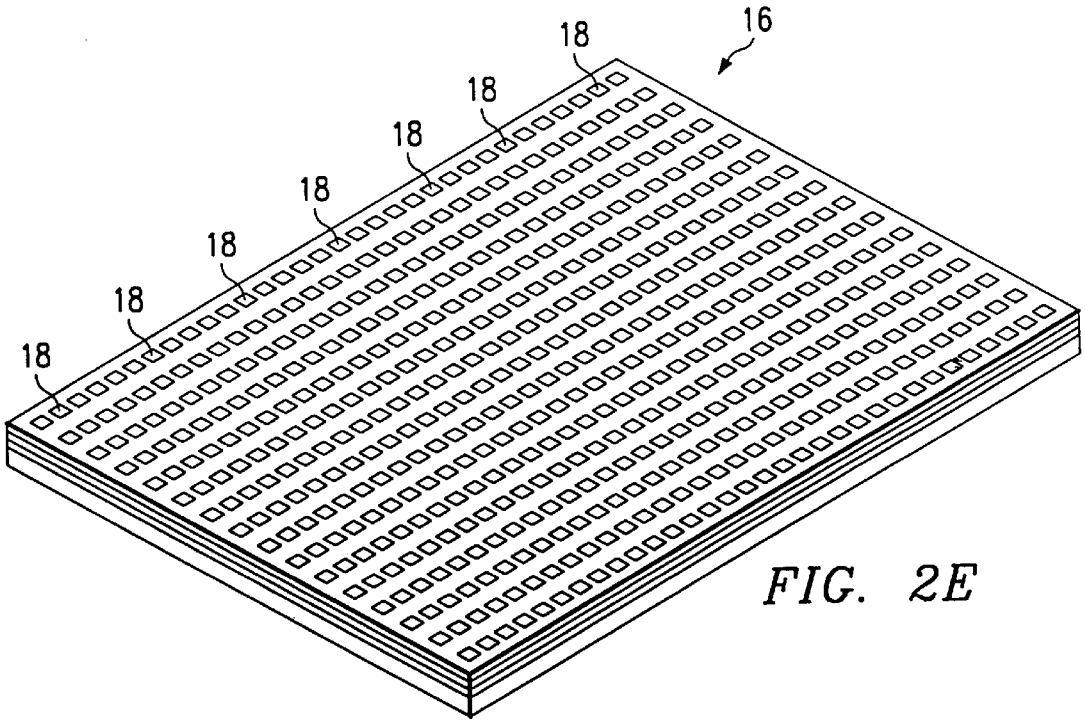

Referring to FIG. 1, there is illustrated subarray partitioning with time delay to correct for misalignment to received signals. A similar arrangement is utilized in the transmit mode. Typically transmitted signals are received by means of a phased array antenna and are "steered" using analog phase shifters located within the Transmit/Receive modules mounted at the radiating face of the antenna array. Using a received signal as an example as illustrated in FIG. 1, inbound energy to the phased array is received at an off-bore site angle θ. Active or passive elements are spaced along the antenna array with a center-to-center spacing of "d" such that as the energy is received by each element, a phase shift as given by the expression:

$$\phi = \frac{-2\pi d}{\lambda}\sin\theta$$

is required to align signals at each element for phase coherent processing.

For large antenna arrays, the bandwidth and the size of the array must be considered for phase coherent processing. The size of the array is related to the "fill-time", that is, the reciprocal of bandwidth is fill-time.

The size "D" of the antenna array or subarray for phase coherent processing is determined by the following equation:

$$D \le \frac{c}{\beta\sin\theta}$$

where:

c=speed of light,

β=the array or subarray bandwidth.

When the dimension "D" is below a given threshold for the bandwidth, then phase adjusting may be utilized as the sole means for steering and phase coherent antenna processing. When the dimension "D" exceeds the threshold, the array must be divided into subarrays that are space apart by distance "D" as illustrated in FIG. 1.

Connected to each of the subarrays of FIG. 1, following element signal formation, there is a time delay unit (TDU) for each subarray. These time delay units are identified as: $\Delta\tau_0$, $\Delta\tau_1$, and $\Delta\tau_2$. The time delays are interconnected to the subarrays to compensate for the time delay difference between the subarrays as a receiving signal crosses the large area of the antenna array. The incremental time delay from one subarray to the next subarray is determined by the scan angle θ and the size of the subarray as given by the relationship:

$$\Delta\tau = \frac{D\sin\theta}{c}$$

Referring to FIGS. 2A, 2B, 2C, 2D, and 2E, there is illustrated an exemplary antenna array 10 comprised of three panels 12. Each panel is divided into a number of long subarrays (LSA) 14. In this system, each panel has four long subarrays 14 and is composed of eight sub-panels 16. Therefore, for the antenna array 10 there are 96 sub-panels 16. On each sub-panel 16 there are 512 antenna elements 18 for receiving and transmitting a data signal. In the antenna array 10, there are 49,152 antenna elements 18.

Figure 3:
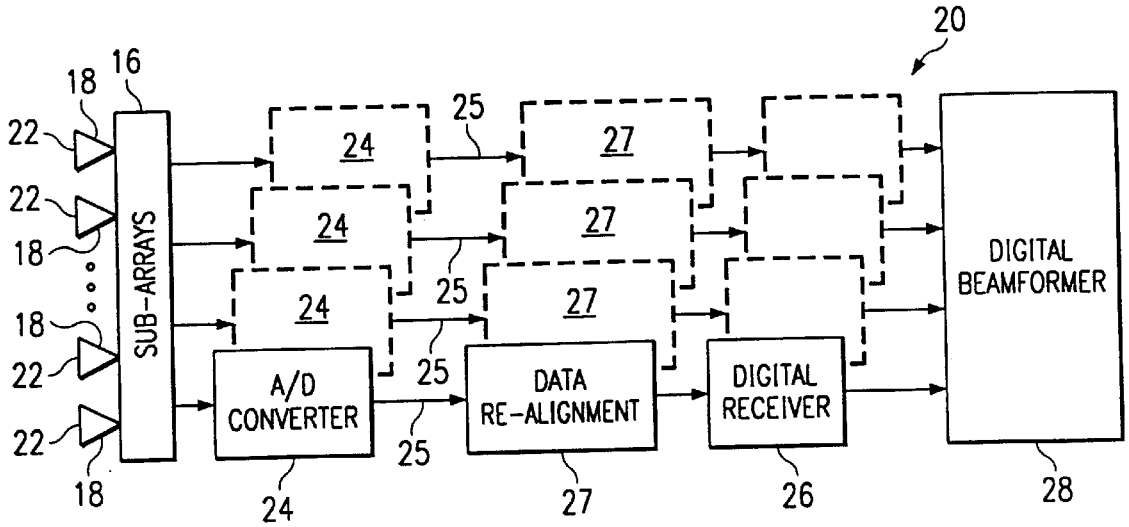
FIG. 3 illustrates a digital antenna data processing system with data realignment in accordance with the present invention.

Referring to FIG. 3, there is illustrated a digital antenna array configuration in accordance with the teachings of the present invention. The Digital antenna array 20 comprises sub-panels 16 coupled to analog-to-digital converters 24. In turn, the analog-to-digital converters 24 are coupled through a data re-alignment circuit 27 to a digital receiver 26, which is coupled to a digital beamformer 28.

Sub-panel 16, as described, has 512 elements 18, each element capable of receiving and sending data signals. FIG. 3 illustrates data signals 22 received at the elements 18 of sub-panel 16. In a typical phased array antenna, each element 18 of sub-panel 16 receives data signals 22.

As illustrated, the analog-to-digital converters 24 receive data signals 22 from antenna elements 18 and converts the received signals from an analog format to a digital format on line 25. In one embodiment, each analog-to-digital converter 24 receives and combines the signals from eight antenna elements 18 in sub-panel 16 as shown in FIG. 1. Other combinations, including providing an analog-to-digital converter for each element, is also possible.

In conventional phased array receiver systems, analog-to-digital conversion occurs after all the output RF signals of each element in the array are first additively combined and then converted to an intermediate frequency. Often the signal combining process is carried out in layers with a subset of elements combined at a subarray level and the separate subarray outputs combined into one or more final signals. The final signal is then conveyed to an analog-to-digital converter, to provide a sampled, digital representation of the overall received signal to digital processing circuitry.

Normally, in conventional phased array receiver systems, the element combining process causes the overall strength of the received RF signal power to increase roughly as the number of elements while the coverall RF noise power increases roughly as the square root of the number of elements. As a result, in conventional systems, the signal presented to the input of the analog-to-digital converter tends to be above the noise floor of the received radar signal. That is, the signal-to-noise ratio of the information at the input of the analog-to-digital converter tends to be much greater than unity. Generally, the effective signal-to-noise ratio of the analog-to-digital converter must be equal to or greater than the best case signal-to-noise ratio of the signal at its input. Also, the dynamic range of the analog-to-digital converter, the range of signals that the analog-to-digital converter can accommodate without saturation, must be equal to or greater than the dynamic range of the input signal. Therefore, in conventional systems a multi-bit analog-to-digital converter is used to avoid loss of information due to noise or saturation effects. In a typical conventional system a ten-bit analog-to-digital converter is necessary.

However, the signal-to-noise ratio of RF signals received by a single element or a small number of elements within a phased array receiver is generally less than unity. The total noise power due to external effects such as atmospheric noise, and internal noise due to temperature effects tend to be greater than the power of the desired radio frequency signal at each element. Since each analog-to-digital converter 24 receives signals directly from antenna elements 18 of the sub-panel 16, the received radar signals are generally below the noise floor. This allows for the use of an analog-to-digital converter with comparably fewer bits, less demanding signal-to-noise ratio, and dynamic range. In one embodiment of the present invention, a one-bit analog-to-digital converter, also known as a one-bit quantizer, is sufficient for use as analog-to-digital converter 24.

Analog-to-digital converter 24 outputs a binary value of "1" (positive one) if it receives a positive input voltage and outputs a value of "−1" (negative one) if it receives a negative voltage. The average value of the output of analog-to-digital converter 24 follows the average value of the input signal level. When the analog-to-digital converter 24 comprises a single-bit quantizer, it receives an analog signal of Gaussian distributed noise with the mean value of the noise biased by the actual radar signal.

According to the well known "Sampling Theorem," to accurately reproduce the original signal from a sampled signal, the sampling must occur at what is known as the "Nyquist" rate. Usually, a low-pass filter is placed before the analog-to-digital converter to prevent signals with a frequency above the frequency from being sampled by the converter.

After converting the data signals 22 to digital signal format on line 25 by the analog-to-digital converter 24, the digital signal is applied to a data re-alignment circuit 27 that performs various signal processing re-alignment operations on the digital signal. These may include filtering, correcting for Doppler error, adjusting the bandwidth of the signal, extracting the relative phase of the signal output from each subpanel array and other operations.

After processing on the re-alignment circuit 27, the processed signal passes through a digital receiver 26 to a beamformer 28 which combines signals from multiple digital receivers 26 to achieve an aligned signal across array 10. After the signal from one array is recovered other arrays can be combined together and processed to increase signal-to-noise ratio or to perform other processing operations on the effective larger array.

Figure 4:
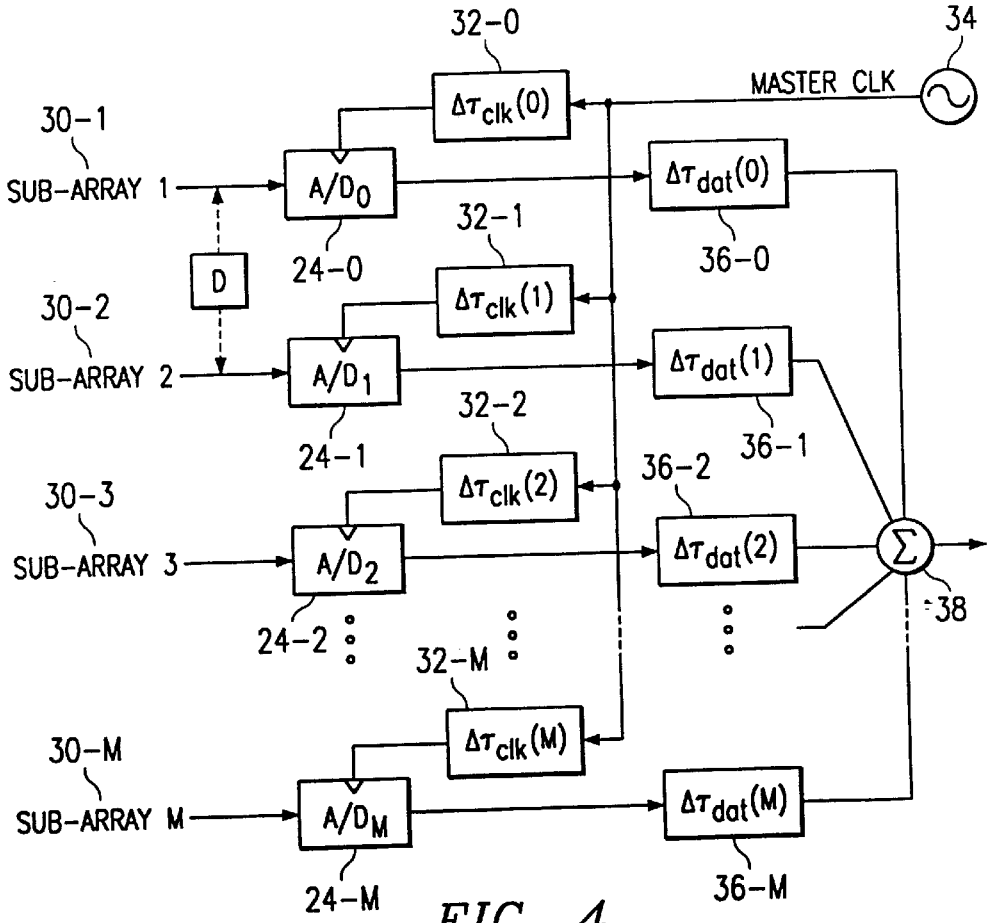
FIG. 4 is a block diagram of an analog/digital data realignment system for zeroing out misalignment due to time steering.

Referring to FIG. 4, there is illustrated an implementation of the realignment circuit 27 connected to a series of subarrays 30-1 through 30-M, each of size "D" as illustrated in FIG. 1. Also as illustrated is FIG. 1, a wave front impinges on the elements of the subarray at an angle θ. The signals from each element of a subarray are combined and input to one of the analog-to-digital converters 24-0 through 24-M.

To provide data realignment in accordance with the present invention, a clock time delay unit 32-0 through 32-M is connected in each of the data paths. Each of the clock time delay units 32-0 through 32-M is connected to a master clock 34 and has an output connected to a respective one of the analog-to-digital converters 24-0 through 24-M. By connecting the clock time delay units in the data path, time misalignment is substantially "zeroed" out due to the time steering created by the master clock 34 connected to the analog-to-digital converters 24-0 through 24-M through respective clock time delay unit 32-0 through 32-M.

As illustrated in FIG. 4, the data time delay units 36-0 through 36-M, connected to an output of a respective analog-to-digital converter 24-0 through 24-M, functions as described with reference to the time delay units illustrated in FIG. 1. The outputs of the data time delay units 36-0 through 36-M are combined in a summing network 38 and transferred to the digital receiver 26.

Each of the clock time delay units 32-0 through 32-M introduces a time delay $\Delta\tau_{clk}$ based on the position of the interconnected subarray thereby aligning signals of the subarrays to compensate for "fill-time" associated with wideband, large antenna arrays. Each of the data time delays units 36-0 through 36-M introduces a time delay $\Delta\tau_{dat}$ to realign (re-synchronize) data to the master clock 34 prior to summation (combining) in the summing network 38. The relationship between the time delay $\Delta\tau_{dat}$ and time delay $\Delta\tau_{clk}$ is given as follows:

$$\Delta\tau_{clk}(n) = \frac{nD\sin\theta}{c},\ \Delta\tau_{dat}(n) = \frac{(M-n)D\sin\theta}{c}$$

where, n=the position of the data time delay unit within the array, and M=the number of subarrays in the antenna to be aligned.

Figure 5:
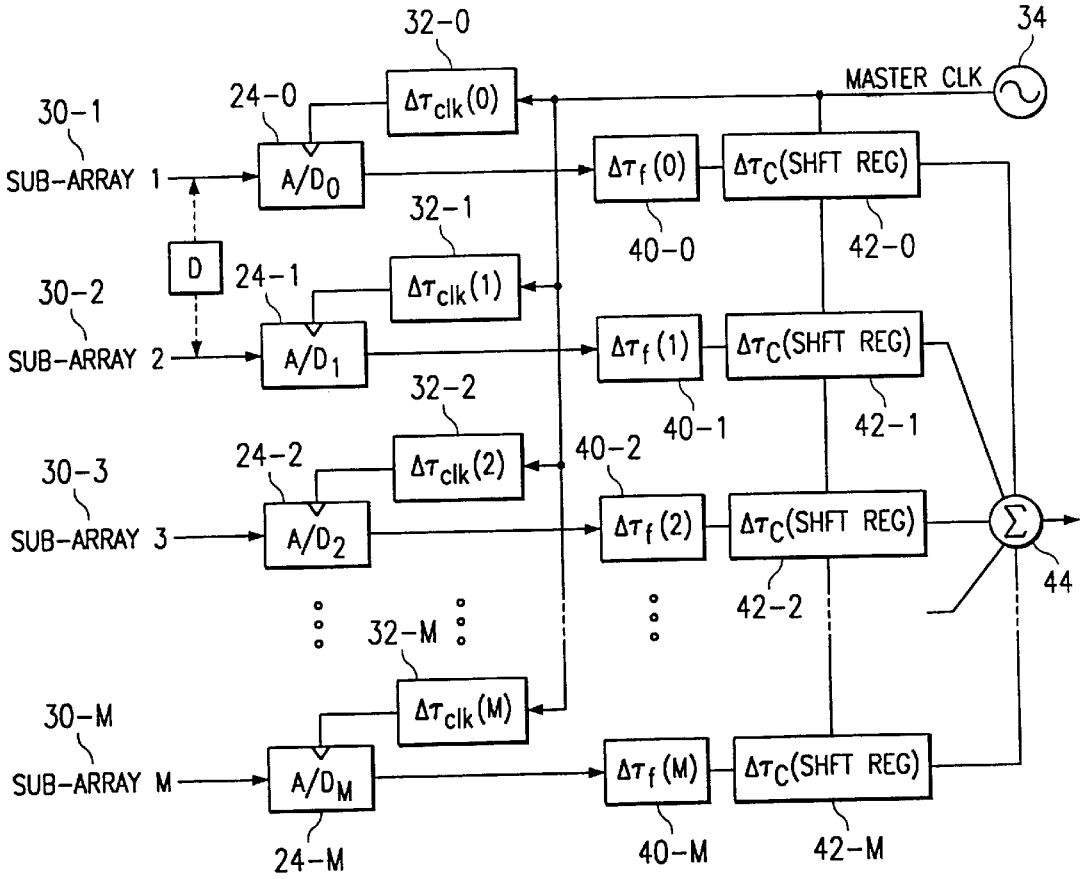
FIG. 5 is a block diagram of an analog/digital data realignment system utilizing coarse and fine adjustment data realignment.

Referring to FIG. 5, there is shown an alternate embodiment of the realignment circuit 27 that includes a "coarse" adjustment and a "fine" adjustment. The subarrays 30-1 through 30-M are connected to a respective analog-to-digital converter 24-0 through 24-M with each of the converters connected to a clock time delay 32-0 through 32-M. Each of the clock time delay units receives an output clock from the master clock 34.

An output of each of the analog-to-digital converters 24-0 through 24-M is connected to a respective fine adjustment time delay unit 40-0 through 40-M for "fine" data realignment adjustment. Realignment of the data continues with the output of the fine adjustment time delay units 40-0 through 40-M connected respectively to a coarse adjustment shift register 42-0 through 42-M. Each of the shift registers 42-0 through 42-M is clocked by the output of the master clock 34. From the shift registers 42-0 through 42-M the realigned data is combined in a summing network 44.

Total delay of data signals for realignment in accordance with the network of FIG. 5 is given by the expression:

$$\Delta\tau_{DAT}=\Delta\tau_{coarse}+\Delta\tau_{fine}$$

where, $$\Delta\tau_{coarse} = \text{MODULO}\left(\frac{F_{data}D\sin\theta}{c}\right)\times\frac{1}{F_{data}}$$

$$\Delta\tau_{fine} < \frac{1}{F_{data}}$$

$F_{data}$=the digital data rate within the shift registers 42-0 through 42-M.

Delay values of the fine and coarse adjustments are incremented in terms of the sample rate ($1/F_s$) as illustrated in FIG. 5 by utilization of programmable time delay shift registers in the data path. Each shift register is programmed to have enough depth to handle maximum delay for each subarray or groups of subarrays.

Although the invention has been described with reference to several embodiments thereof, many variations and modification will become apparent to those skilled in the art. It is therefore the intention that the appended claims be interpreted as broadly as possible in view of the prior art to include all such variations and modifications.

What is claimed is:

1. A data realignment system for an antenna array having plurality of subarrays of radiating/receiving elements, comprising;

a plurality of analog-to-digital converters receiving data signals from the elements of said subarrays and generating digitized output data, said analog-to-digital converters selectively connect to the subarrays of the antenna;

a plurality of time steering clock time delay units connected one-to-one to an input of the analog-to-digital converters to substantially zero out time misalignment due to the angle of a wave front impinging on the elements;

a clock having a clock output applied to each of the plurality of clock time delay units, each clock time delay unit responding to the clock output to provide a set delay to the digitized output data by selecting the sample time of inputs to the analog-to-digital converters; and a plurality of data time delay units connected one-to-one to the plurality of analog-to-digital converters, each data time delay unit providing a set delay to the digitized output data for realignment of data signals from the elements of said antenna.

2. The data realignment system as set forth in claim 1 wherein each subarray of the antenna has a dimension D varying with the bandwidth of the antenna, further comprising;

each clock time delay unit provides a sample time delay varying with the dimension D and the position n of a subarray in the antenna configuration.

3. The data realignment system as set forth in claim 2 further comprising:

each clock time delay unit sets a sample time delay in the respective analog-to-digital converter varying in accordance with the expression:

$$\Delta\tau_{CLK}(n) = \frac{nD\sin\theta}{c}$$

where n=the position of the subarray in the antenna configuration,

D=the length dimension of each subarray of the antenna configuration, and c=the speed of light.

4. The data realignment system as set forth in claim 1 wherein each subarray of the antenna has a dimension D varying with the bandwidth of the antenna, further comprising:

each data time delay unit provides a data signal delay varying the dimension D, the number of subarrays in the antenna for alignment, and the position n of a subarray in the antenna configuration.

5. The data realignment system as set forth in claim 4 further comprising:

each data time delay unit provides a data signal delay in accordance with the expression:

$$\Delta\tau_{dat}(n) = \frac{(M-n)D\sin\theta}{c}$$

where, n=the position of the subarray in the antenna configuration;

M=the number of subarrays in the antenna for alignment,

D=the length dimension of each subarray for alignment, and c=the speed of light.

6. The data realignment system as set forth in claim 1, further comprising:

a summing network having inputs equal in number to the plurality of data time delay units and connected thereto and providing a summation output to a digital receiver.

7. A data realignment system for an antenna array having plurality of subarrays of radiating/receiving elements, comprising;

a plurality of analog-to-digital converters receiving data signals from the elements of each said subarray and generating digitized output data, the analog-to-digital converters selectively connected to the plurality of subarrays;

a plurality of time steering clock time delay units connected one-to-one to an input of the plurality of analog-to-digital converters to substantially zero out time misalignment due to the angle of a wave front impinging on the elements;

a clock having a clock output applied to each of the plurality of clock time delay units, each clock time delay unit in response to the clock output providing a time delay to the generated digitized output data by establishing the sample time for inputs to the analog-to-digital converters;

a plurality of fine adjustment data delay units connected one-to-one to the plurality of analog-to-digital converters, each fine adjustment data delay unit providing a data delay to the digitized output data; and a plurality of coarse adjustment data delay units connected one-to-one to the plurality of fine adjustment data delay units, each of the coarse adjustment data delay units providing a data delay to the digitized output of the fine adjustment data delay unit for realignment of data signals from the elements of said antenna.

8. The data realignment system as set forth in claim 7 wherein each subarray of the antenna has a dimension D varying with the bandwidth of the antenna, further comprising;

each clock time delay unit has a sample time delay varying with the dimension D and the position n of the subarray in the antenna configuration.

9. The data realignment system as set forth in claim 8 further comprising:

each clock time delay unit provides a sample time delay in the respective analog-to-digital converter varying in accordance with the expression:

$$\Delta\tau_{CLK}(n) = \frac{nD\sin\theta}{c}$$

where:

n=the position of the subarray in the antenna configuration,

D=the length dimension of each subarray of the antenna configuration, and c=the speed of light.

10. The data realignment system as set forth in claim 7 wherein each subarray of the antenna has a dimension D varying with the bandwidth of the antenna, further comprising;

each coarse adjustment data delay unit provides a data delay varying with the dimension D and the digital data rate of the delay unit.

11. The data realignment system as set forth in claim 10 further comprising;

each coarse adjustment data delay unit provides a data delay in accordance with the expression:

$$\Delta\tau_c = \mathrm{mod}\left(\frac{F_{data}D\sin\theta}{c}\right) \times \frac{1}{F_{data}}$$

where, $F_{data}$=the digital data rate of the delay unit,

D=the dimension of each subarray for alignment, and c=the speed of light.

12. The data realignment system as set forth in claim 11 further comprising:

each fine adjustment data delay unit provides a data delay in accordance with the expression:

$$\Delta\tau_f \leq \frac{1}{F_{data}}.$$

13. The data realignment system as set forth in claim 7, further comprising;

a summing network having inputs equal in number to the plurality coarse adjustment data delay units and connected thereto and providing a summation output to a digital receiver.

14. The data realignment system set forth in claim 7 wherein each of the coarse adjustment data delay units comprise a shift register coupled to receive the clock output.

* * * * *